US010803800B2

(12) United States Patent
An

(10) Patent No.: US 10,803,800 B2
(45) Date of Patent: Oct. 13, 2020

(54) DISPLAY DEVICE AND DRIVING METHOD OF THE SAME

(71) Applicant: Samsung Display Co., Ltd., Yongin-si, Gyeonggi-do (KR)

(72) Inventor: Boyoung An, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 52 days.

(21) Appl. No.: 16/190,638

(22) Filed: Nov. 14, 2018

(65) Prior Publication Data

US 2019/0164486 A1 May 30, 2019

(30) Foreign Application Priority Data

Nov. 27, 2017 (KR) ..... 10-2017-0159646

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2320/029* (2013.01); *G09G 2320/0285* (2013.01); *G09G 2320/043* (2013.01); *G09G 2320/046* (2013.01); *G09G 2320/0693* (2013.01); *G09G 2340/0464* (2013.01); *G09G 2360/16* (2013.01)

(58) Field of Classification Search
CPC ..... G09G 3/3233; G09G 3/3275; G09G 2360/16; G09G 2320/043; G09G 2320/0285; G09G 2320/046; G09G 2320/029; G09G 2320/0693; G09G 2340/0464
See application file for complete search history.

(56) References Cited

U.S. PATENT DOCUMENTS

2014/0232409 A1* 8/2014 Keum ..... G09G 3/006 324/414
2016/0189618 A1* 6/2016 Park ..... G09G 3/3233 345/690
2017/0162103 A1 6/2017 An et al.

* cited by examiner

*Primary Examiner* — Christopher J Kohlman
(74) *Attorney, Agent, or Firm* — Lewis Roca Rothgerber Christie LLP

(57) ABSTRACT

A display device includes a display panel including pixels, a degradation compensator configured to divide the display panel into one or more unit blocks initially including reference pixels, to calculate a stress data using the unit blocks, and to compensate an image data to generate a compensation data based on an accumulate stress data including an accumulation of the stress data, a data driver configured to generate a data signal based on the compensation data provided from the degradation compensator, and to provide the data signal to the pixels, a scan driver configured to provide a scan signal to the pixels, and a timing controller configured to control the data driver and the scan driver, wherein the degradation compensator is configured to generate the accumulate stress data including the stress data of adjacent pixels that are adjacent to the reference pixels by moving the unit blocks in a moving path.

20 Claims, 12 Drawing Sheets

DISPLAY DEVICE AND DRIVING METHOD OF THE SAME

CROSS-REFERENCE TO RELATED APPLICATION

This application claims priority to, and the benefit of, Korean Patent Application No. 10-2017-0159646, filed on Nov. 27, 2017 in the Korean Intellectual Property Office (KIPO), the contents of which are incorporated herein in its entirety by reference.

BACKGROUND

1. Field

Embodiments of the present inventive concept relate to a display device, and a driving method of the same.

2. Description of the Related Art

Flat panel display (FPD) devices are widely used as a display device of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. The OLED devices have been spotlighted as next-generation display devices because the OLED devices have various advantages, such as a wide viewing angle, a rapid response speed, thinness, low power consumption, etc.

An organic light emitting diode included in the OLED device is degraded as time passes. Luminance of the organic light emitting diode decreases, and a sticking image occurs as the organic light emitting diode is degraded. Thus, a method for detecting a degradation of the organic light emitting diode and compensating the degradation is studied.

SUMMARY

Some embodiments provide a display device capable of improving display quality.

Some embodiments provide a driving method of the display device capable of improving display quality.

According to an aspect of embodiments, a display device may include a display panel including a plurality of pixels, a degradation compensator configured to divide the display panel into one or more unit blocks initially including reference pixels, to calculate a stress data using the unit blocks, and to compensate an image data to generate a compensation data based on an accumulate stress data including an accumulation of the stress data, a data driver configured to generate a data signal based on the compensation data provided from the degradation compensator, and to provide the data signal to the pixels, a scan driver configured to provide a scan signal to the pixels, and a timing controller configured to control the data driver and the scan driver, wherein the degradation compensator is configured to generate the accumulate stress data including the stress data of adjacent pixels that are adjacent to the reference pixels by moving the unit blocks in a moving path.

The degradation compensator may include a unit block determiner configured divide the display panel into the one or more unit blocks, and to move the unit blocks in the moving path, a calculator configured to calculate the stress data of the pixels in the unit blocks, a memory configured to receive the stress data from the calculator, and to store the accumulate stress data of each of the unit blocks, and a data compensator configured to compensate the image data based on the accumulate stress data.

The calculator may be configured to calculate an average value of stress values to represent a degradation degree of the pixels in the unit blocks, and to output the average value as the stress data in every frame.

The calculator may sequentially output a stress value that represents a degradation degree of a respective pixel of the pixels in the unit blocks as the stress data in every frame.

The stress value of an outermost pixel of the pixels may be output as the stress data when a number of pixels in one of the unit blocks at an edge of the display panel is less than a reference number.

The unit block determiner may be configured to move the unit block in a first direction or a second direction to include the adjacent pixels.

The unit block determiner may be configured to move the unit block to include pixels around the reference pixels.

The unit block may move by a movement amount in a frame.

The unit block may move by a movement amount that is less than 30% of either a length or a width of the unit block.

The unit block may move in a first direction, and in a second direction that is perpendicular to the first direction.

The unit block may move by a predetermined number of pixels.

According to an aspect of embodiments, a driving method of a display device may include dividing a display panel including a plurality of pixels into one or more unit blocks initially including a plurality of reference pixels, calculating a stress data using the unit blocks, generating an accumulate stress data based on an accumulation the stress data, moving the unit blocks by a movement amount, and compensating an image data to generate a compensation data based on the accumulate stress data.

The stress data may be calculated by calculating an average value of stress values to represent a degradation degree of the pixels in a corresponding one of the unit blocks in every frame.

The stress data may be calculated by sequentially outputting a stress value representing a degradation degree of a respective pixel of the pixels in a corresponding one of the unit blocks in every frame.

Moving the unit blocks may include moving a corresponding one of the unit blocks in a first direction to include pixels adjacent to the reference pixels.

Moving the unit blocks may include moving a corresponding one of the unit blocks in a second direction to include pixels adjacent to the reference pixels.

Moving the unit blocks may include moving a corresponding one of the unit blocks to include pixels around the reference pixels.

Moving the unit blocks may include moving a corresponding one of the unit blocks by the movement amount in each frame.

Moving the unit blocks may include moving a corresponding one of the unit blocks less than 30% of a dimension of the unit block.

The movement amount may include a predetermined number of pixels.

Therefore, the display device, and the driving method of the display device, may improve a deviation of display quality that occurs between the unit blocks due to a difference of a compensation amount of degradation of the unit blocks by dividing the display panel into the unit blocks that includes the reference pixels, generating an accumulate stress data that includes stress data of the reference pixels and the pixels adjacent to the reference pixels by moving the unit blocks, and compensating an image data based on the accumulate stress data.

BRIEF DESCRIPTION OF THE DRAWINGS

Illustrative, non-limiting embodiments will be more clearly understood from the following detailed description taken in conjunction with the accompanying drawings.

DETAILED DESCRIPTION

Figure 1:
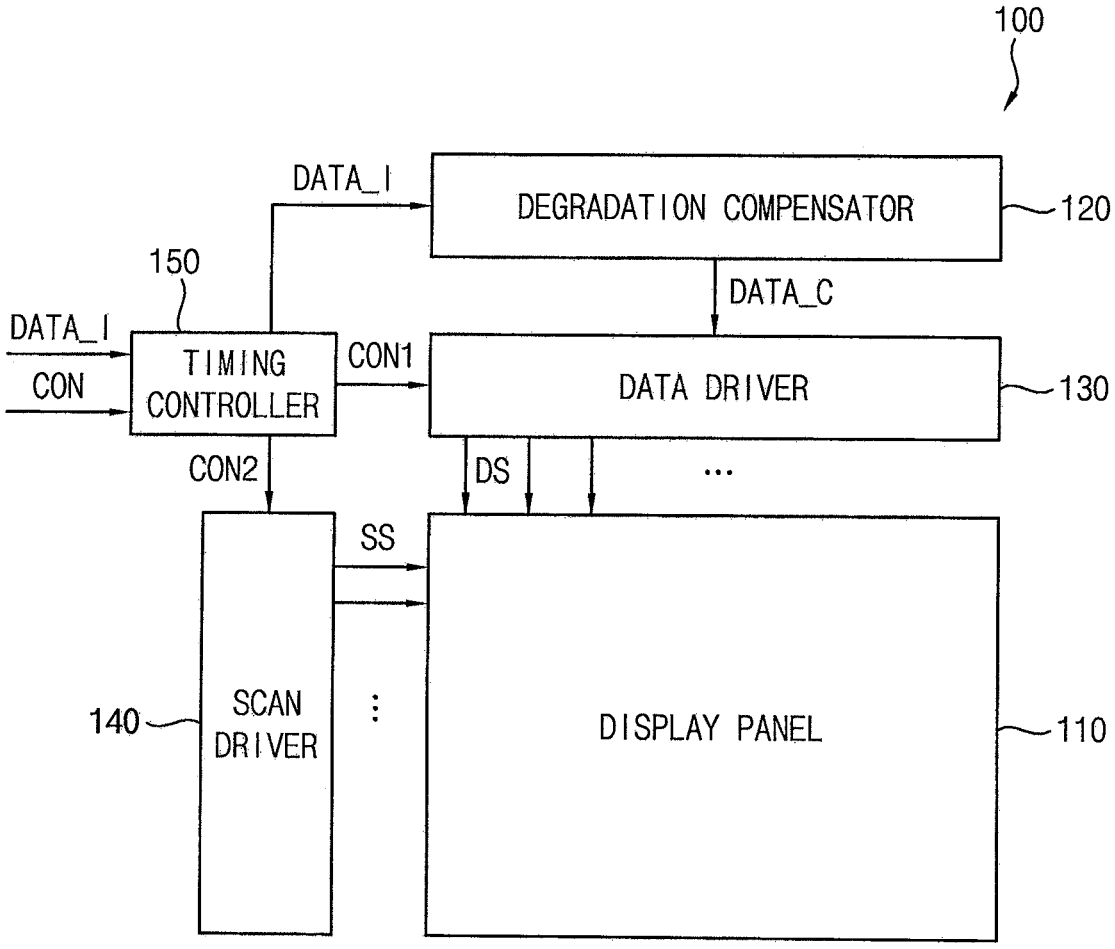
FIG. 1 is a block diagram illustrating a display device according to embodiments.

Features of the inventive concept and methods of accomplishing the same may be understood more readily by reference to the following detailed description of embodiments and the accompanying drawings. Hereinafter, embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, embodiments of the present inventive concept will be explained in detail with reference to the accompanying drawings.

Figure 2:
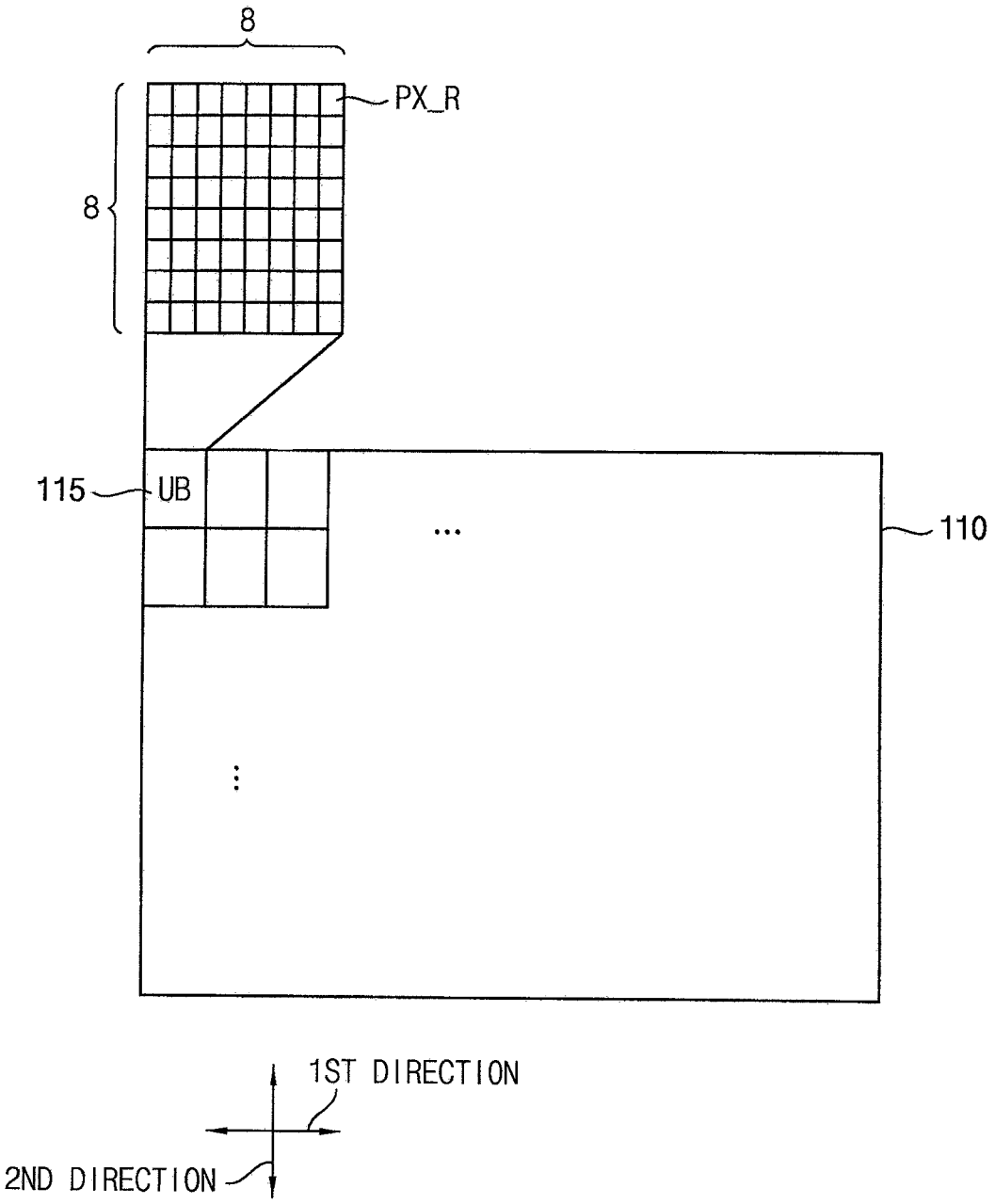
FIG. 2 is a diagram for describing a unit block into which a display panel included in the display device of FIG. 1 is divided.

FIG. 1 is a block diagram illustrating a display device according to embodiments, and FIG. 2 is a diagram for describing a unit block into which a display panel included in the display device of FIG. 1 is divided.

Referring to FIG. 1, a display device 100 may include a display panel 110, a degradation compensator 120, a data driver 130, a scan driver 140, and a timing controller 150.

The display panel 110 may include a plurality of pixels. A plurality of data lines and a plurality of scan lines may be formed in the display panel 110. A plurality of pixels may be formed in crossing areas of the data lines and the scan lines. In some embodiments, each of the pixels may include a pixel circuit, a driving transistor, and an organic light emitting diode. In this case, the pixel circuit may transfer a data signal DS provided through the data line to the driving transistor in response to a scan signal SS provided through the scan line. The driving transistor may control a driving current flowing through the organic light emitting diode based on the data signal DS. The organic light emitting diode may emit light based on the driving current.

The organic light emitting diode included in each of the pixels may be degraded, and luminance of the pixel may decrease, as an accumulation driving time and an accumulation driving amount of the pixel increases. A technique that divides the display panel into a plurality of unit blocks, and that compensates the pixels included in each of the unit block based on an accumulate stress data (e.g., an accumulation stress data) of the pixels in each of the unit block, is used to compensate the decreased luminance of the pixel. In this case, a compensation amount of degradation for each of the unit blocks may be different from each other according to an image data DATA_I provided to the pixels in each of the unit blocks. Thus, a boundary line between the unit blocks may be recognized by a user. The display device 100 according to embodiments may reduce or prevent a recognizable boundary line of the unit blocks 115 by dividing the display panel 110 into the plurality of unit blocks 115, and by generating accumulate stress data that includes stress data of pixels adjacent to reference pixels PX_R by moving the unit blocks 115 in a moving path (e.g., a predetermined moving path). Hereinafter, the degradation compensator 120 of the display device 100 may be described in detail.

The degradation compensator 120 may divide the display panel 110 into the plurality of unit blocks 115 that includes the plurality of reference pixels PX_R, calculate the stress data for each of the unit blocks 115, and compensate an image data DATA_I provided from an external device to a generate compensation data DATA_C based on an accumulate stress data in which the stress data are accumulated.

For example, the degradation compensator 120 may include a unit block determiner, a calculator, a memory, and a data compensator. The unit block determiner may determine the unit block 115 that includes the reference pixels PX_R and may move the unit block 115 in the moving path. Referring to FIG. 2, the unit block determiner may divide the display panel 110 into the plurality of unit blocks 115 that includes the plurality of reference pixels PX_R. The unit block 115 may include M*N reference pixels PX_R, where the M and N are integers that are equal to or greater than 1. For example, the unit block 115 may include 8*8 reference pixels PX_R, as shown in FIG. 2. The unit block determiner may move the unit block 115 in the moving path to include the pixels adjacent to the reference pixels PX_R. In some embodiments, the unit block determiner may move the unit block 115 to include the pixels adjacent to the reference pixels PX_R in a first direction 1ST DIRECTION and the pixels adjacent to the reference pixels PX_R in a second direction 2ND DIRECTION. In other embodiments, the unit block determiner may move the unit block 115 to include the pixels around the reference pixels PX_R. The unit block 115 may move by a movement amount (e.g., a predetermined movement amount) in a frame (e.g., in a predetermined frame).

For example, the unit block 115 may move the movement amount once in every 60 frames when the stress data is accumulated every 1 second. For example, the unit block 115 may move under 30% of a size of the unit block 115. The unit block 115 may move under, or less than, 2.4 pixels, which is 30% of 8 pixels, in the first direction 1ST DIRECTION or in the second direction 2ND DIRECTION when the unit block 115 includes 8*8 pixels. The unit block 115 may move to an upper side, a lower side, a right side, a left side, and a diagonal side (e.g., may move upwards, downwards, to the right, to the left, and/or diagonally). The unit block 115 may move in the moving path. For example, the unit block 115 may move to the left, to the right, upward, and downward according to the moving path to accumulate the stress data of pixels adjacent to the reference pixels PX_R. The unit block 115 may move by a given number of pixels (e.g., a predetermined number, or a movement number) based on the moving path.

The calculator may calculate the stress data of the pixels included in the unit block 115. The calculator may calculate the stress data based on the image data DATA_I. Further, the calculator may calculate the stress data based on luminance information, load information, temperature information, information of a degree of the stress per each of grayscales, etc. as well as based on the image data DATA_I. In some embodiments, the calculator may calculate an average value of the stress values that represents a degradation degree of the pixels included in the unit block 115 in every frame as the stress data. In other embodiments, the calculator may sequentially output a stress value that represents a degradation degree of one pixel of the pixels included in the unit block 115 as the stress data. For example, the calculator may sequentially output the degradation degree of the pixel included in the unit block 115 as the stress data during 64 frames when the unit block 115 includes 8*8 pixels. The calculator may calculate the stress data when the unit block 115 moves. For example, the calculator may calculate the stress data of the reference pixel PX_R and the stress data of the pixels to the left side of the reference pixel PX_R when the calculator calculates the stress data of the unit block 115 that includes the reference pixel PX_R and moves to the left side of the reference pixels PX_R.

The memory may receive the stress data from the calculator, and may store the accumulate stress data by the unit blocks 115. The memory may store the accumulate stress data by adding the stress data provided from the calculator. For example, the memory may be a non-volatile memory device. The memory may store each of the accumulate stress data of the unit blocks 115.

The data compensator may compensate the image data DATA_I based on the accumulate stress data. The data compensator may determine a compensating amount of degradation, and may compensate the image data DATA_I to generate the compensation data DATA_C based on the compensating amount of degradation. Here, the compensating amounts for the degradation of unit blocks 115 may be different from each other because the accumulate stress data of the unit blocks 115 are different from each other. The data compensator may generate the compensation data DATA_C, whereby the image data DATA_I provided to the reference pixel PX_R is compensated by adjusting the compensating amount of degradation based on each of the accumulate stress data to the pixels included in each of the unit block 115. Here, the boundary line between adjacent unit blocks 115 may be unrecognizable because the accumulate stress data includes the stress data of the pixels around the reference pixels PX_R as well as the reference pixels PX_R included in the unit block 115.

The data driver 130 may generate a data signal DS based on the compensation data DATA_C provided from the degradation compensator 120, and may provide the data signal DS to the pixels. The data driver 130 may generate the data signal DS corresponding to the compensation data DATA_C in response to a first control signal CON1 provided from the timing controller 150, and may output the data signal DS to the data line in the display panel 110.

The scan driver 140 may provide a scan signal SS to the pixels. The scan driver 140 may generate the scan signal SS in response to a second control signal CON2 provided from the timing controller 150, and may output the scan signal SS to the scan line in the display panel 110.

The timing controller 150 may receive the image data DATA_I, which may be externally supplied. The timing controller 150 may provide the image data DATA_I to the degradation compensator 120. Further, the timing controller 150 may generate the first control signal CON1 that controls the data driver 130, and the second control signal CON2 that controls the scan driver 140. The timing controller 150 may output the first control signal CON1 to the data driver 130, and may output the second control signal CON2 to the scan driver 140.

As described above, the display device 100 of FIG. 1 may improve a deviation of display quality between the unit blocks 115 by dividing the display panel 110 into the unit blocks 115 including the plurality of reference pixels PX_R, generating the accumulate stress data that includes stress data of the reference pixels PX_R and of the pixels adjacent to the reference pixels PX_R by moving the unit blocks 115, and compensating the image data DATA_I to generate the compensation data DATA_C based on the accumulate stress data.

Figure 3:
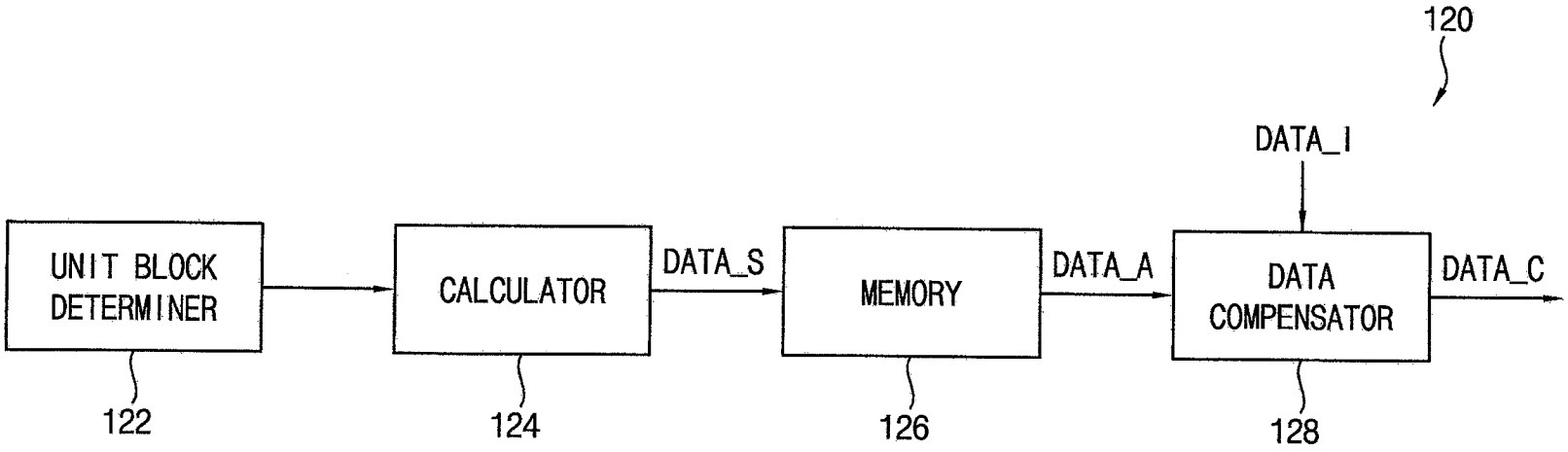
FIG. 3 is a block diagram illustrating a degradation compensator included in the display device of FIG. 1.
Figure 4:
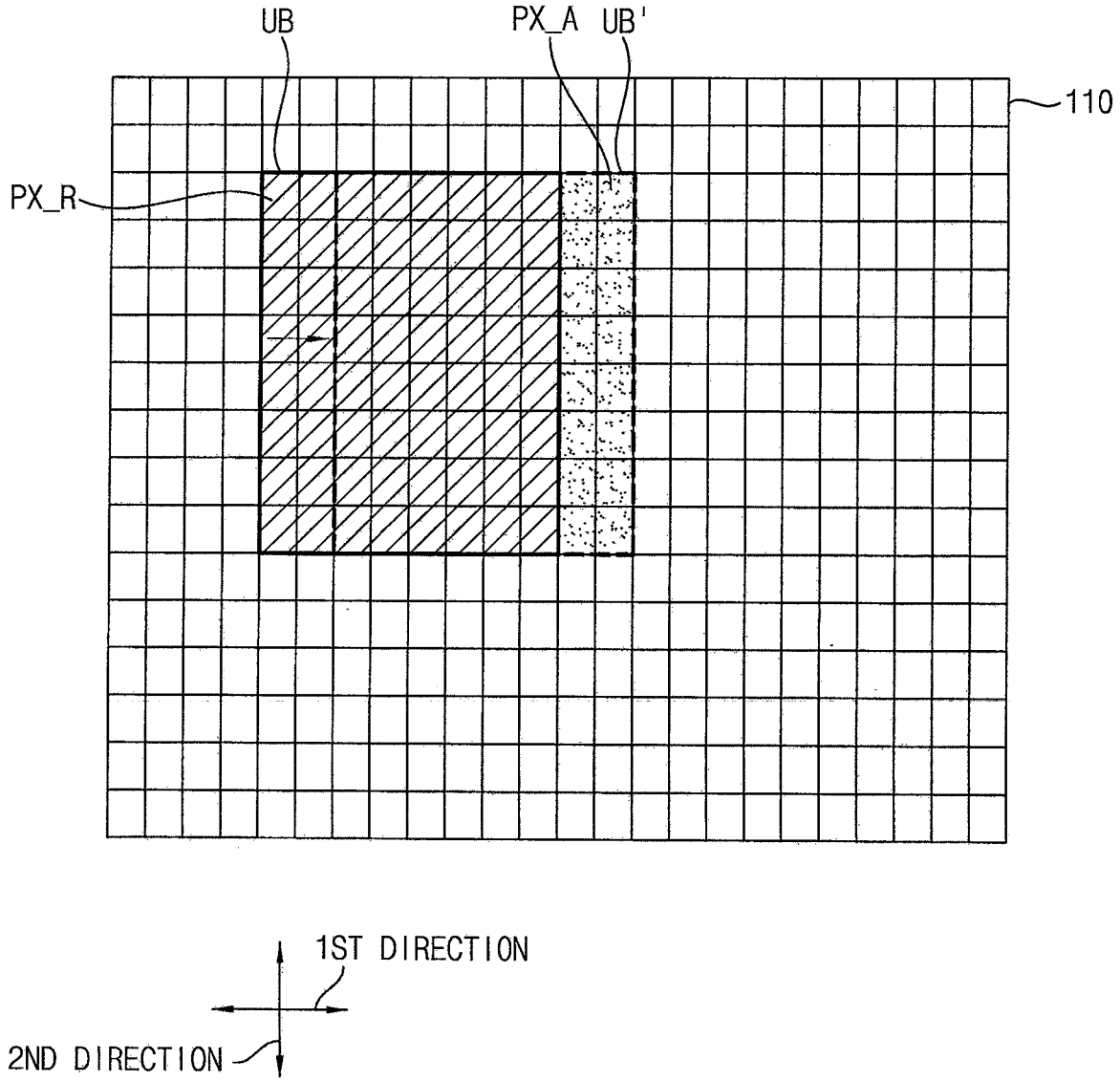
FIG. 4 is a diagram for describing an operation of a unit block determiner included in the degradation compensator of FIG. 3.
Figure 5A:
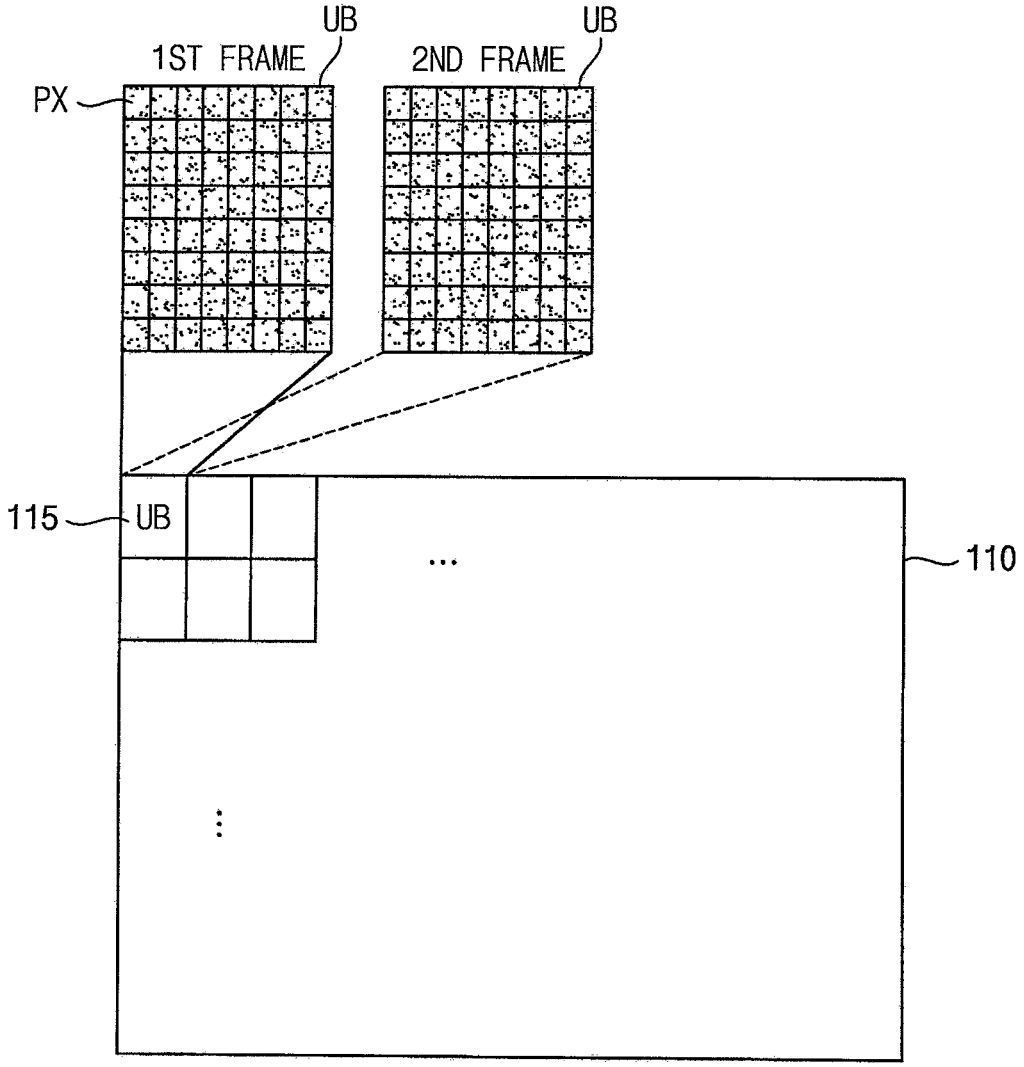
FIGS. 5A and 5B are diagrams illustrating an operation of a calculator included in the degradation compensator of FIG. 3.
Figure 5B:
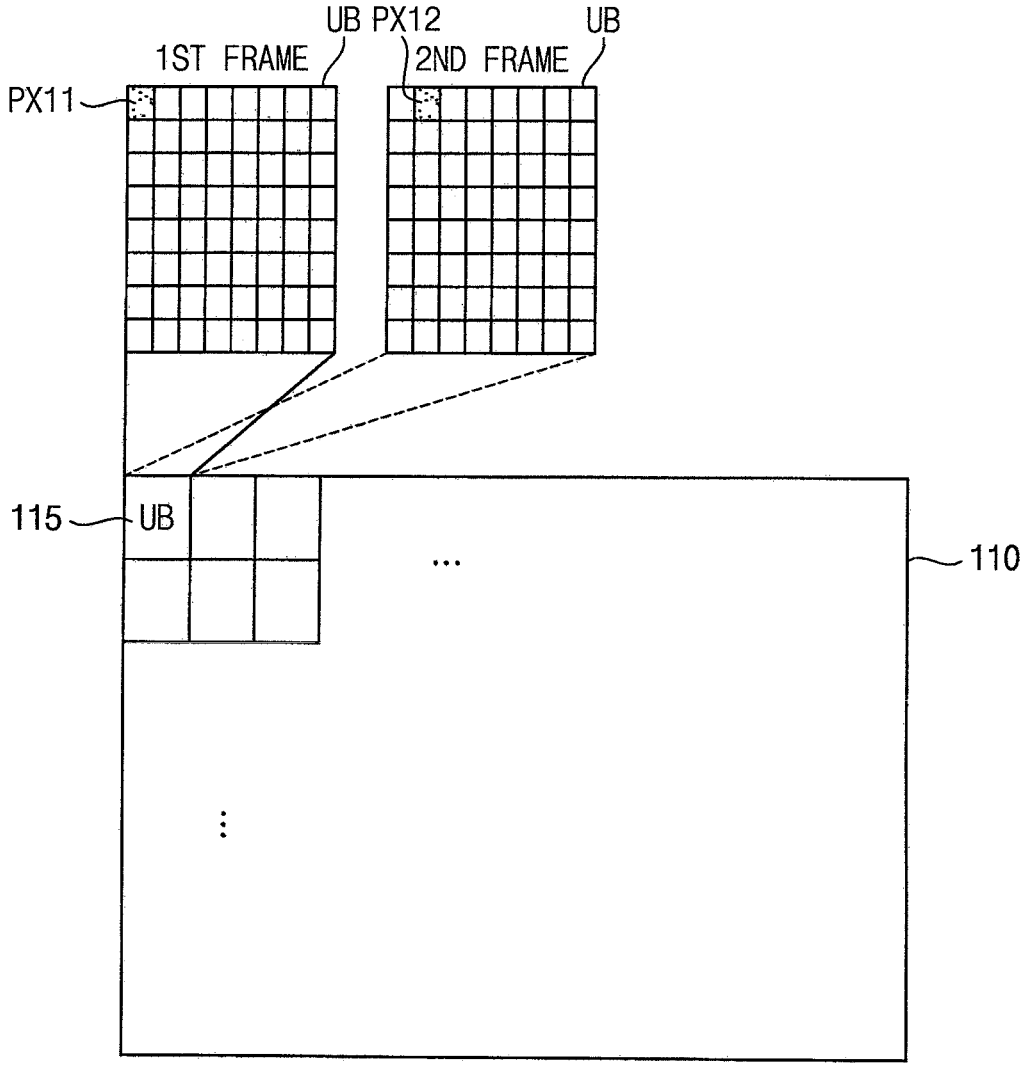

FIG. 3 is a block diagram illustrating a degradation compensator included in the display device of FIG. 1. FIG. 4 is a diagram for describing an operation of a unit block determiner included in the degradation compensator of FIG. 3. FIGS. 5A and 5B are diagrams illustrating an operation of a calculator included in the degradation compensator of FIG. 3.

Referring to FIG. 3, the degradation compensator 120 may include the unit block determiner 122, the calculator 124, the memory 126, and the data compensator 128.

The unit block determiner 122 may determine the unit block UB that includes the reference pixels, and may move the unit block UB in the moving path. Referring to FIG. 4, the unit block UB may include the plurality of reference pixels PX_R. For example, the unit block determiner 122 may determine a unit block UB that includes 8*8 reference pixels PX_R, as shown in FIG. 4. The unit block determiner 122 may move the unit block UB after an amount of time (e.g., a predetermined amount of time). The unit block determiner 122 may move the position of the unit block (e.g., from unit block UB to unit block UB') to include pixels PX_A adjacent to the reference pixels PX_R (e.g., may move the position of the unit block upwards, downwards, to the right, to the left, and/or diagonally). Here, the unit block determiner 122 may move the unit block UB based on a chosen movement amount. For example, the unit block determiner 122 may move the unit block UB 2 pixels to the right of the reference pixel PX_R, as shown in FIG. 4. The unit block UB', to which the unit block UB is moved, may include 6*8 reference pixels PX_R included in the initial unit block UB, and may also include 2*8 pixels PX_A that are adjacent to (e.g., to the right of) the plurality of the reference pixels PX_R. The unit block determiner 122 may move the unit block UB in the first direction of the reference pixels PX_R and/or the second direction that is perpendicular to the first direction according to the moving path. Although the unit block determiner 122 is described as moving the unit block UB 2 pixels to the right in FIG. 4, the movement amount is not limited thereto. For example, the unit block determiner 122 may move the unit block UB by 1 pixel. The unit block determiner 122 may move the unit block UB a distance that is less than 30% of a size of the unit block UB to improve accuracy.

The calculator 124 may calculate the stress data DATA_S of the pixels in the unit block UB. The calculator 124 may calculate the stress data DATA_S based on the received image data DATA_I, which may be received by the degradation compensator 120 from the timing controller 150 (e.g., see FIG. 1). Further, the calculator 124 may calculate the stress data DATA_S based on the luminance information, the load information, the temperature information, the information of the degree of the stress per each of grayscales, etc., as well as based on the image data DATA_I.

Referring to FIG. 5A, the calculator 124 may calculate the average value of the stress values that represents the degradation degree of the pixels PX in the unit block UB, and may output the average value as the stress data DATA_S in every frame. The calculator 124 may receive the stress values of the pixels PX in the unit block UB in every frame, and may calculate the average value of the stress values. The calculator 124 may calculate 480 stress data DATA_S (that is, 480=60 frames*8) when the unit block is moved 8 times per second.

Referring to FIG. 5B, the calculator 124 may sequentially output a stress value that represents the degradation of one pixel of the pixels included in the unit block UB as the stress data DATA_S in every frame. The calculator 124 may output a stress value of the pixel PX11 arranged in position (1, 1) of the unit block UB as the stress data DATA_S in a first frame, and may output a stress value of the pixel PX12 arranged in position (1, 2) of the unit block UB as the stress data DATA_S in a second frame. The calculator 124 may sequentially output the stress values of the remaining pixels PX arranged in the unit block UB as the stress data DATA_S in the same method. The calculator 124 may output stress data DATA_S during 64 frames when the unit block UB includes 8*8 pixels, and when the calculator 124 output the stress data DATA_S once in every frame (e.g., one stress value of the stress data DATA_S per frame for each of the pixels of the 8*8 unit block UB). Here, the unit block determiner 122 may move the unit block UB after outputting the 64 stress data DATA_S.

The calculator 124 may calculate and output the stress data DATA_S based on the image data DATA_I provided to the pixels in the unit block UB when the unit block UB moves.

The memory 126 may receive the stress data DATA_S from the calculator 124, and may store the accumulate stress data DATA_A for each of the unit blocks UB. Referring to 5A, the calculator 124 may output the average value of the stress values of the pixels in the unit block UB as the stress data DATA_S, and the memory 126 may sum, or accumulate, the stress data DATA_S to be stored as the accumulate stress data DATA_A.

Referring to 5B, the calculator 124 may sequentially output the stress value of the pixels in the unit block UB as the stress data DATA_S, and the memory 126 may sum the stress data DATA_S to be stored as the accumulate stress data DATA_A. The memory 126 may store the accumulate stress data DATA_A based on the stress data DATA_S provided from the calculator 124 when the unit block UB moves. Here, the memory 126 may be the non-volatile memory device.

The data compensator 128 may compensate the image data DATA_I based on the accumulate stress data DATA_A. The data compensator 128 may determine the compensating amount of the degradation of the image data DATA_I provided from the timing controller 150 based on the accumulate stress data DATA_A, and may compensate the image data DATA_I to generate the compensation data DATA_C based on the compensating amount of the degradation. Here, the accumulate stress data DATA_A may include the stress data DATA_S of the reference pixels PX_R and of the pixels PX_A adjacent to the reference pixels PX_R. Thus, the deviation of display quality that may occur due to the difference between the unit blocks may be reduced to improve overall display quality.

Figure 6:
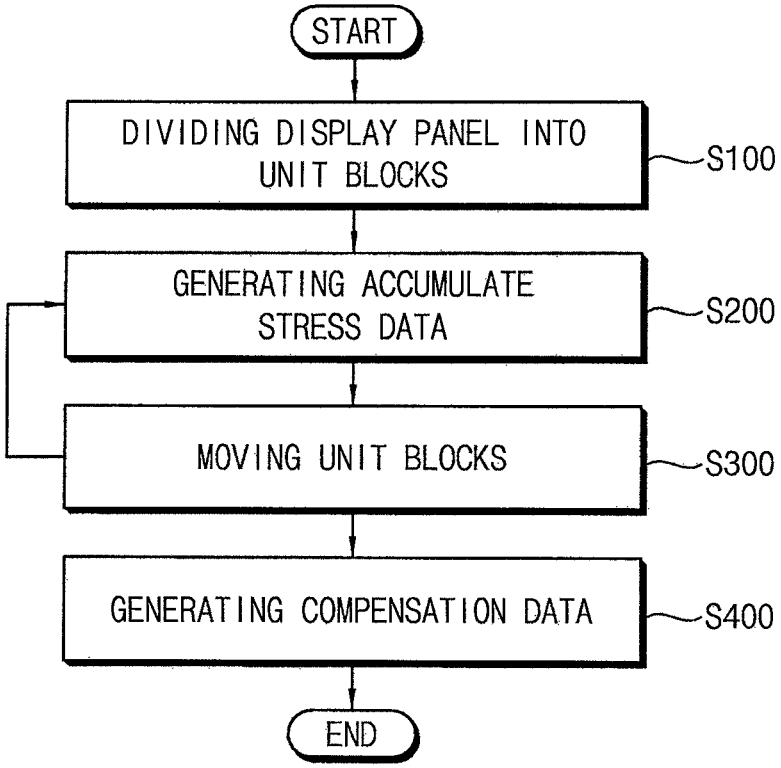
FIG. 6 is a flowchart illustrating a driving method of a display device according to embodiments.

FIG. 6 is a flowchart illustrating a driving method of a display device according to embodiments.

Referring to FIG. 6, a driving method of a display device may include dividing the display panel into a plurality of unit blocks S100, generating an accumulate stress data in each of the unit blocks S200, moving the unit blocks S300, and generating a compensation data S400.

The driving method of the display device may divide the display panel into the plurality of unit blocks S100. Each of the unit blocks may include a plurality of reference pixels.

The driving method of the display device may generate the accumulate stress data per unit blocks S200. The driving method of the display device may calculate the stress data of the unit blocks based on an image data. In some embodiments, the driving method of the display device may calculate an average value of the stress values that represents a degradation degree of the pixels included in the unit block in every frame, and may output the average value as the stress data. In other embodiments, the driving method of the display device may sequentially output the stress value that represents the degradation degree of one respective pixel included in the unit block as the stress data in every frame. The driving method of the display device may generate the accumulate stress data by adding up, accumulating, or summing the stress data.

The driving method of the display device may move the unit blocks by a movement amount S300. The driving method of the display device may move the unit blocks in a first direction and/or a second direction that is perpendicular to the first direction. The unit blocks may move by the movement amount. The unit block that moves may include some of the reference pixels of a previous unit block, and may also include pixels that are adjacent to the reference pixels of the previous unit block. The driving method of the display device may generate the accumulate stress data of the pixels in the unit block that moves. The unit blocks may move according to a moving path (e.g., a predetermined moving path). In some embodiments, the unit block may move to include the pixels adjacent to the reference pixels in the first direction and/or to include the pixels adjacent to the reference pixels in the second direction. In other embodiments, the unit block may move to include the pixels around the reference pixels.

The driving method of the display device may compensate the image data to generate the compensation data based on the accumulate stress data S400. The driving method of the display device may determine the compensation amount of the degradation of the image data based on the accumulate stress data, and may compensate the image data to generate the compensation data based on the compensation amount of the degradation. Here, a deviation of display quality, which otherwise occurs due to the difference between the unit blocks, may be reduced to improve overall display quality because the accumulate stress data includes the stress data of the pixels adjacent to the reference pixels as well as the stress data of the reference pixels.

Figure 7A:
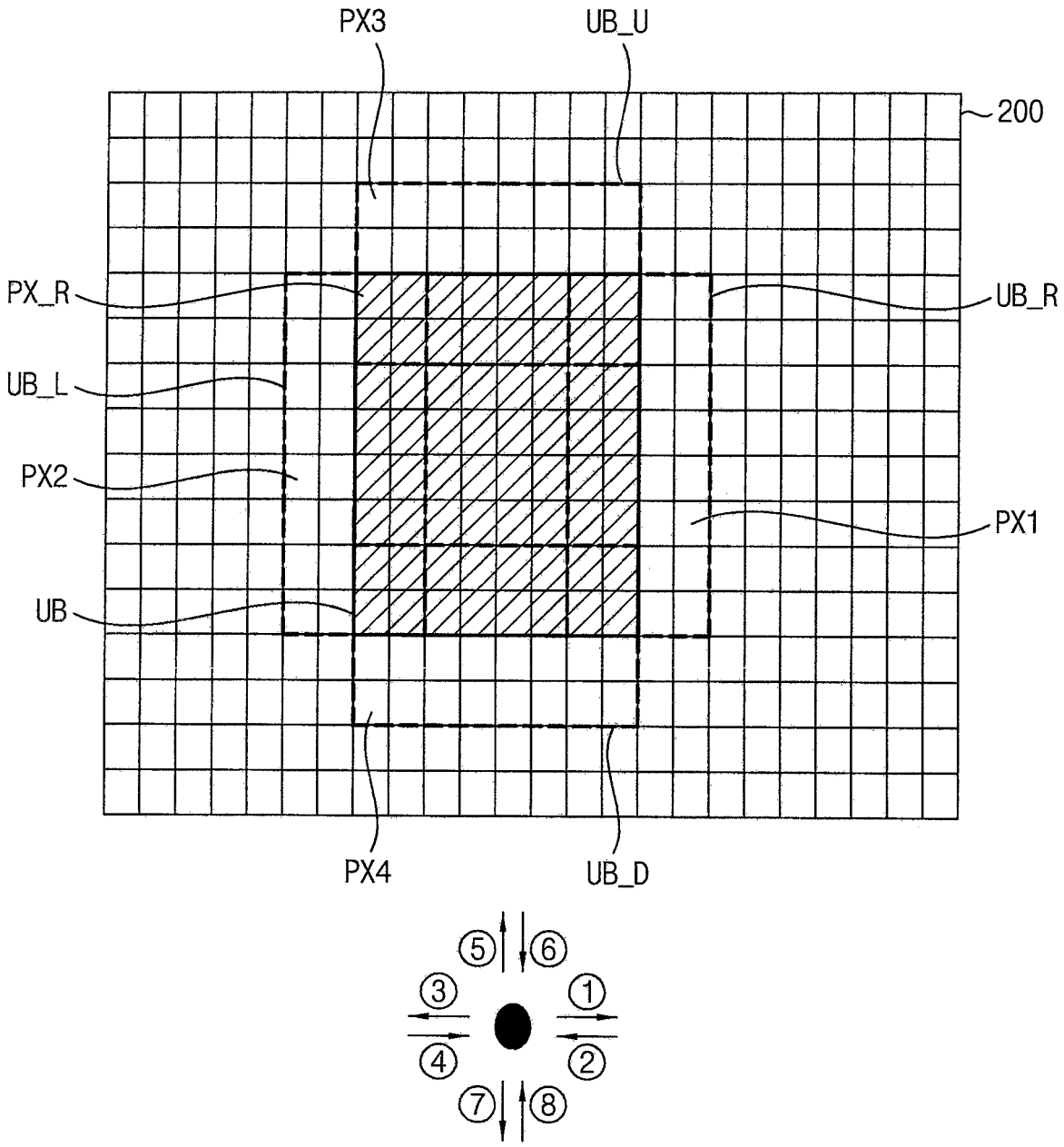
FIGS. 7A and 7B are diagrams illustrating an example of the driving method of the display device described with respect to FIG. 6.
Figure 7B:
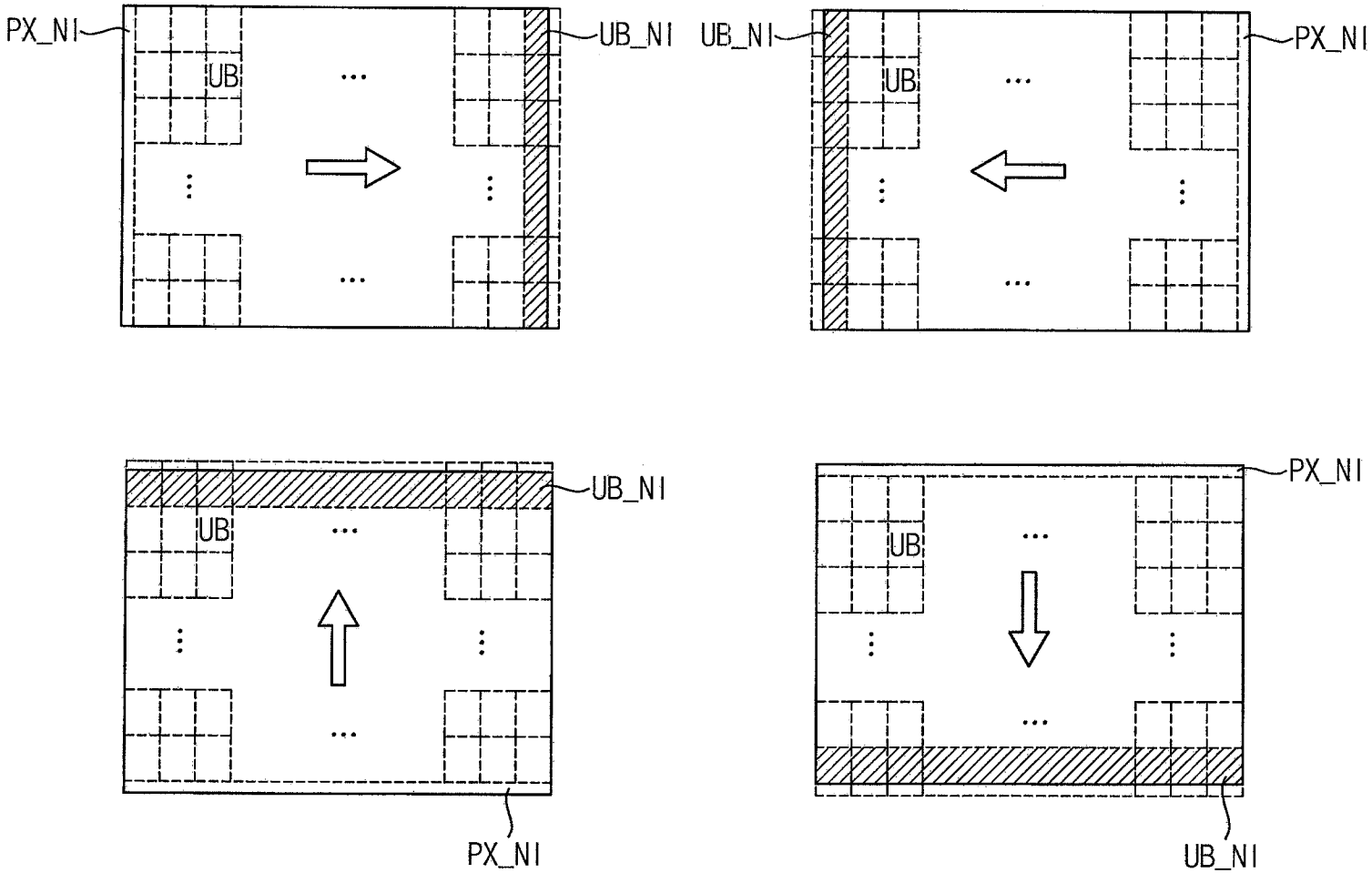

FIGS. 7A and 7B are diagrams illustrating an example of the driving method of the display device described with respect to FIG. 6.

Referring to FIG. 7A, the unit block UB may include the plurality of reference pixels PX_R. The driving method of the display device may output the stress data based on the stress value of the reference pixels PX_R included in the unit block UB, and may generate the accumulate stress data based on the stress data. The unit block UB may move according to the depicted moving path ①~⑧. Here, the unit block UB may move by a movement amount (e.g. a predetermined movement amount). Although the unit block UB moves by 2 pixels in FIG. 7A, the movement amount is not limited thereto. For example, the unit block UB may move by only 1 pixel.

The unit block UB may move to a right side (e.g., toward the right) ① of the reference pixels PX_R. The unit block UB_R that moves to the right may include some of the reference pixels PX_R and may include pixels PX1 that are adjacent to the reference pixels PX_R along the right side. The driving method of the display device may output the stress data based on the stress values of the pixels PX_R and PX1 included in the unit block UB_R that is moved to the right, and may generate the accumulate stress data based on the stress data.

The unit block UB_R that moves to the right side may then move to a left side (e.g., toward the left) ②. Here, the unit block UB may include the reference pixels PX_R. The driving method of the display device may output the stress data based on the stress values of the reference pixels PX_R included in the unit block UB, and may generate the accumulate stress data based on the stress data.

The unit block UB may move to the left side (e.g., may again move toward the left) ③ of the reference pixels PX_R. The unit block UB_L that moves to the left side may include some of the reference pixels PX_R along with pixels PX2 that are adjacent to the reference pixels PX_R on the left side thereof. The driving method of the display device may output the stress data based on the stress values of the pixels PX_R and PX2 included in the unit block UB_L that is moved to the left side, and may generate the accumulate stress data based on the stress data.

The unit block UB_L that moves to the left side may thereafter move to the right side (e.g., may again move to the right) ④. Here, the unit block UB may include the reference pixels PX_R. The driving method of the display device may output the stress data based on the stress values of the reference pixels PX_R included in the unit block UB, and may generate the accumulate stress data based on the stress data.

The unit block UB may move upward, or may move to the upper side of the reference pixels PX_R. The unit block UB_U that moves to the upper side may include a part of the plurality of reference pixels PX_R as well as pixels PX3 that are adjacent to the reference pixels PX_R at an upper side thereof. The driving method of the display device may output the stress data based on the stress values of the pixels PX_R and PX3 included in the unit block UB_U that moves to the upper side, and may generate the accumulate stress data based on the stress data.

The unit block UB_U that moves to the upper side may then move downwardly, or may move to the lower side ⑥. Here, the unit block UB may include the reference pixels PX_R. The driving method of the display device may output the stress data based on the stress values of the reference pixels PX_R included in the unit block UB, and may generate the accumulate stress data based on the stress data.

The unit block UB may then continue to move downwardly/move to the lower side ⑦ of the reference pixels PX_R. The unit block UB_D that moves to the lower side may include a part of the plurality of the reference pixels PX_R and may include pixels PX4 adjacent to the reference pixels PX_R at a lower side thereof. The driving method of the display device may output the stress data based on the stress values of the pixels PX_R and PX4 included in the unit block UB_D at the lower side, and may generate the accumulate stress data based on the stress data.

The unit block UB_D that moves to the lower side may then move upwardly/may move toward the upper side thereof ⑧. Here, the unit block UB may include the reference pixels PX_R. The driving method of the display device may output the stress data based on the stress values of the reference pixels PX_R included in the unit block UB, and may generate the accumulate stress data based on the stress data.

As described above, the driving method of the display device may generate the accumulate stress data that includes the stress values of the reference pixels PX_R and the pixels PX1, PX2, PX3, and PX4 adjacent to the reference pixels PX_R respectively at the right side, the left side, the upper side and the lower side by moving the unit block UB.

Referring to FIG. 7B, the unit blocks UB may move to the right side, the left side, the upper side, and the lower side. Here, the pixels arranged in an edge of the display panel might not be included in the unit block UB. Alternatively, the unit block UB arranged in the edge of the display panel may not include some of the pixels. For example, the pixels PX_NI in the left side of the display panel might not be included in the unit block UB, and the unit blocks UB_NI in the right side of the display panel may include a number of pixels that are under, or less than, a number (e.g., a predetermined number, or a reference number, which may correspond to a number of reference pixels, such as 8*8 reference pixels) when the unit block UB moves to the right side of the display panel. The pixels PX_NI in the right side of the display panel might not be included in the unit block UB, and the unit blocks UB_NI in the left side of the display panel may include a number of pixels that is less than the corresponding number when the unit block UB moves to the left side of the display panel. The pixels PX_NI in the lower side of the display panel might not be included in the unit block UB, and the unit block UB_NI in the upper side of the display panel may include a number of pixels that is less than the corresponding number when the unit block UB moves to the upper side of the display panel. The pixels PX_NI in the upper side of the display panel might not be included in the unit block UB, and the unit block UB_NI in the lower side of the display panel may include a number of pixels that is less than the corresponding number when the unit block UB moves to the lower side of the display panel.

The driving method of the display device may calculate the average value of the stress values of the pixels included in the unit blocks UB_NI that include the pixels under, or less than, a chosen number, and may output the average value as the stress data by calculating the average value of the stress values of the pixels in the unit block UB. For example, the unit block UB_NI at the right side of the display panel may include 6*8 pixels when the unit blocks UB includes the 8*8 reference pixels and moves 2 pixels to the left. In this case, the stress data of the unit block UB_NI at the right side of the display panel may be output by calculating the average value of the stress values of 6*8 pixels.

The driving method of the display device may re-output the stress value of the outermost pixel in the unit block UB_NI, which includes a number of pixels that is less than the corresponding number, as the stress data when the stress value of one pixel in the unit block UB is sequentially output as the stress data. For example, the unit block UB_NI at the right side of the display panel may include 6*8 pixels when the unit blocks UB includes the 8*8 reference pixels and may move by 2 pixels to left side. In this case, the stress value of the outermost pixel may re-output in output timing of the stress data of the pixels not included in the unit block UB_NI at the right side of the display panel.

Figure 8A:
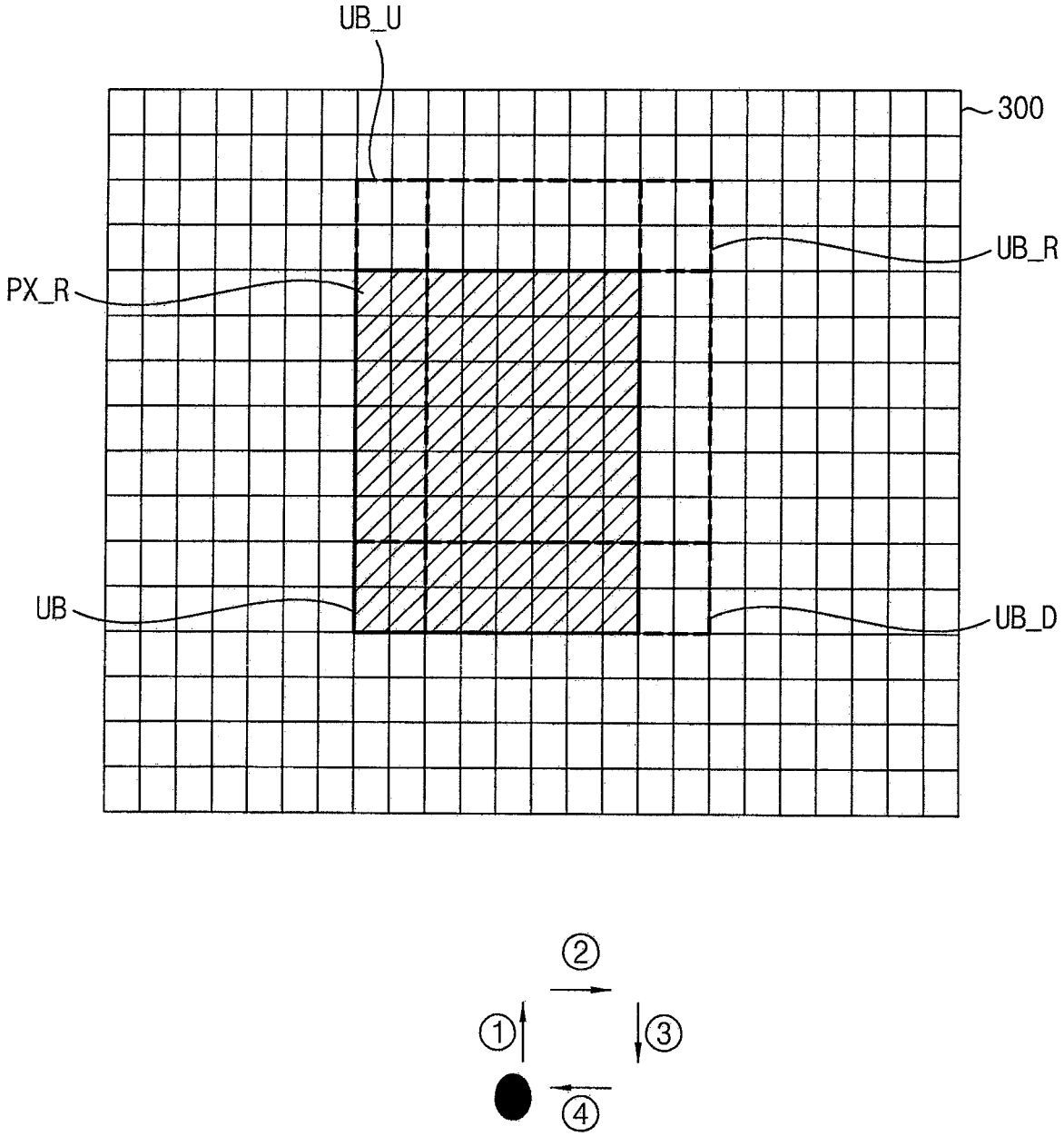
FIGS. 8A through 8C are diagrams illustrating another example of the driving method of the display device described with respect to FIG. 6.
Figure 8B:
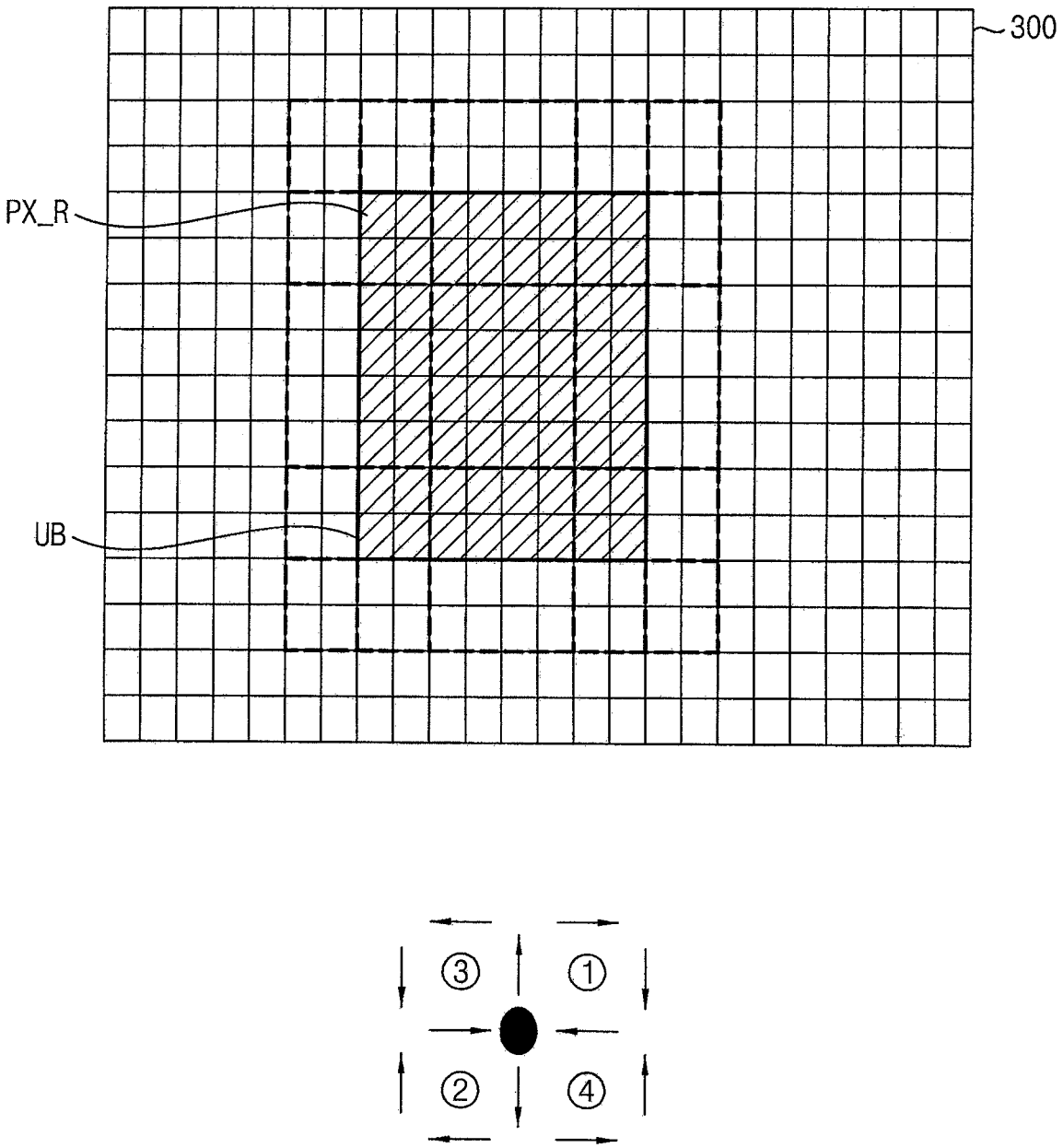
Figure 8C:
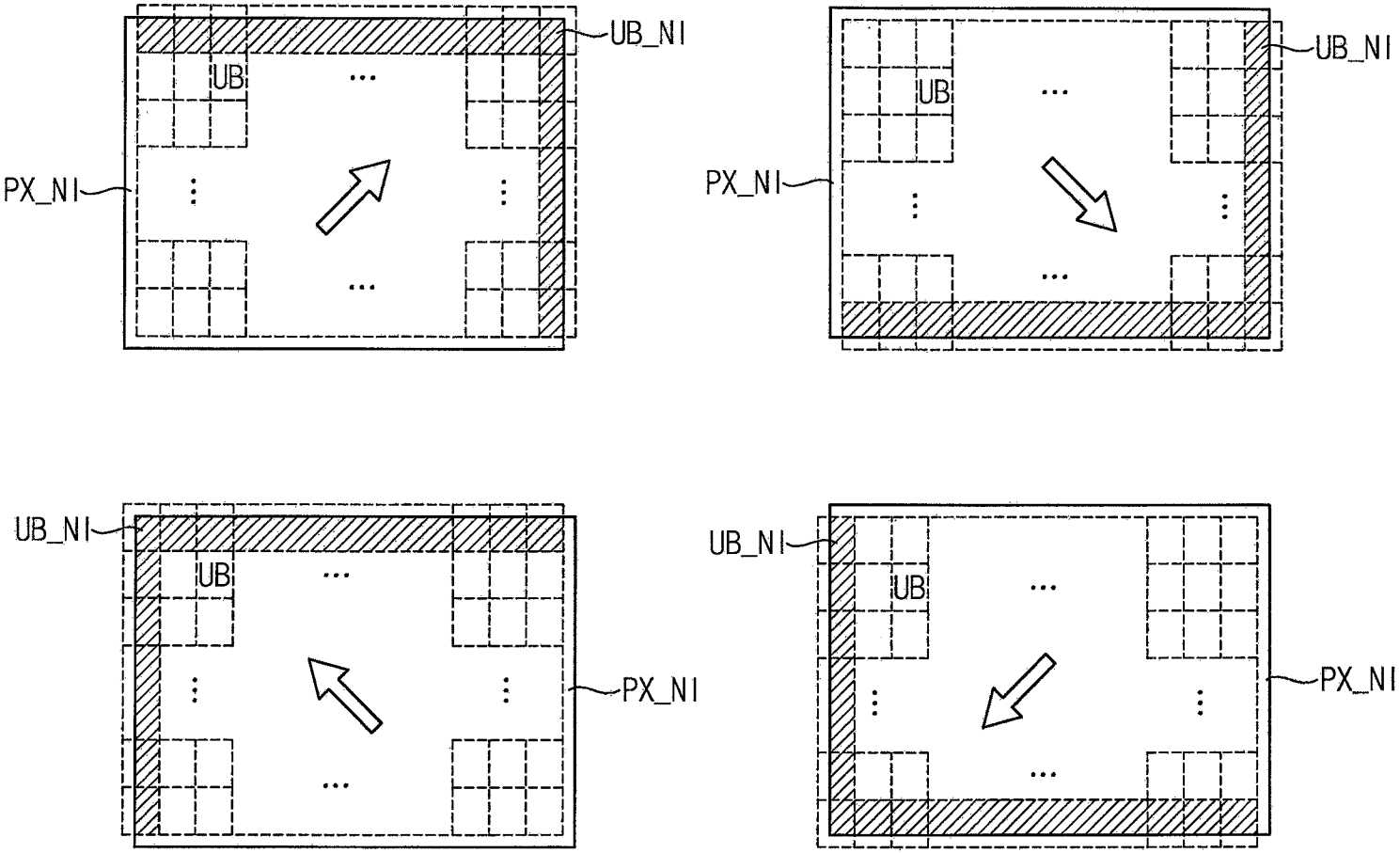

FIGS. 8A through 8C are diagrams illustrating another example of the driving method of the display device described with respect to FIG. 6.

Referring to FIG. 8A, the unit block UB may include the plurality of reference pixels PX_R. The driving method of the display device may output the stress data based on the stress value of the reference pixels PX_R included in the unit block UB, and may generate the accumulate stress data based on the stress data. The unit block UB may move in the moving path ①~④. Here, the unit block UB may move by the movement amount. Although the unit block UB in the present embodiment moves by 2 pixels, as shown in FIG. 8A, the movement amount is not limited thereto. For example, the unit block UB may move by 1 pixel.

The unit block UB may move to an upper side ① of the reference pixels PX_R. The unit block UB_U that moves to the upper side may include some of the reference pixels PX_R and some of the pixels adjacent to the reference pixels PX_R in the upper side. The driving method of the display device may output the stress data based on the stress values of the pixels included in the unit block UB_U that moves to the upper side, and may generate the accumulate stress data based on the stress data.

The unit block UB_U that moves to the upper side may move to a right side ②. Thus, the unit block UB_U may be at a right-upper side of the reference pixels PX_R. The unit block UB_R that moves to the right may include some of the reference pixels PX_R, some of the pixels adjacent to the reference pixels PX_R in the upper side, some of the pixels adjacent to the reference pixels PX_R in the right side, and some of the pixels adjacent to reference pixels PX_R in the right-upper side. The driving method of the display device may output the stress data based on the stress values of the pixels included in the unit block UB_R that moves to the right, and may generate the accumulate stress data based on the stress data.

The unit block UB_R that moves to the right side may then move to a lower side Thus, the unit block UB_D may be at a right side of the reference pixels PX_R. The unit block UB_D that moves downwardly may include some of the reference pixels PX_R and some of the pixels adjacent to the reference pixels PX_R in the right side. The driving method of the display device may output the stress data based on the stress values of the pixels included in the unit block UB_D that moves downwardly, and may generate the accumulate stress data based on the stress data.

The unit block UB_D that moves downwardly may then move to a left side ④. Thus, the unit block UB that moves to the left side may include the reference pixels PX_R. The driving method of the display device may output the stress data based on the stress values of the pixels included in the unit block UB that moves to the left, and may generate the accumulate stress data based on the stress data.

As described above, the driving method of the display device may generate the accumulate stress data including the stress value of the reference pixels PX_R and the pixels adjacent to the reference pixels PX_R in the upper side, the right side, and the right-upper side by moving the unit block UB according the moving path.

Referring to FIG. 8B, the unit block UB may move in the moving path ①~④. Here, a first moving path ① of FIG. 8B may include the moving path of FIG. 8A. The accumulated stress data that includes the stress values of the pixels adjacent to the reference pixels PX_R in the upper side, the right side, and the right-upper side may be generated based on the first moving path ①. The accumulate stress data that includes the stress values of the pixels adjacent to the reference pixels PX_R in the lower side, the left side, and a left-lower side may be generated based on a second moving path ②. The accumulate stress data that includes the stress values of the pixels adjacent to the reference pixels PX_R in the upper side, the left side, and a left-upper side may be generated based on a third moving path ③. The accumulate stress data that includes the stress values of the pixels adjacent to the reference pixels PX_R in the lower side, the right side, and a right-lower side may be generated based on a fourth moving path ④.

As described above, the driving method of the display device may generate the accumulate stress data including the stress values of the reference pixels PX_R and the pixels adjacent to the reference pixels PX_R in the upper side, the right side, the lower side, the left side, and a diagonal side (e.g., toward right-upper, left lower, left-upper, and/or right-lower sides) by moving the unit block UB according to the moving path.

Referring to FIG. 8C, the unit blocks UB may move to the diagonal direction. Here, the pixels arranged at an outer edge of the display panel might not be included in the unit block UB. Alternatively, the unit block UB arranged at the outer edge of the display panel may not include some of the pixels. For example, the pixels PX_NI in the left side and lower side of the display panel might not be included in the unit block UB, and the unit blocks UB_NI in the right side and the upper side of the display panel may include a number of pixels that is less than the corresponding number when the unit block UB moves to the right-upper side of the display panel. The pixels PX_NI in the left side and upper side of the display panel might not be included in the unit block UB, and the unit blocks UB_NI in the right side and the lower side of the display panel may include a number of pixels that is less than the corresponding number when the unit block UB moves to the right-lower side of the display panel. The pixels PX_NI in the right side and lower side of the display panel might not be included in the unit block UB, and the unit blocks UB_NI in the left side and the upper side of the display panel may include a number of pixels that is less than the corresponding number when the unit block UB moves to the left-upper side of the display panel. The pixels PX_NI in the right side and upper side of the display panel might not be included in the unit block UB, and the unit blocks UB_NI in the left side and the lower side of the display panel may include a number of pixels that is less than the corresponding number when the unit block UB moves to the left-lower side of the display panel.

The driving method of the display device may calculate an average value of the stress values of the pixels included in the unit blocks UB_NI that includes a number of pixels that is less than the corresponding number and output the average value as the stress data when the stress data is output by calculating the average value of the stress values of the pixels in the unit block UB.

The driving method of the display device may re-output the stress value of the outermost pixel in the unit block UB_NI that includes a number of pixels that is less than the corresponding number as the stress data when the stress value of one pixel in the unit block UB is sequentially output as the stress data.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel comprising a plurality of pixels;

a degradation compensator configured to divide the display panel into one or more unit blocks initially comprising reference pixels, to calculate a stress data using the unit blocks by calculating a stress value for each pixel of one of the unit blocks, and to compensate an image data to generate a compensation data based on an accumulate stress data comprising an accumulation of the stress data;

a data driver configured to generate a data signal based on the compensation data provided from the degradation compensator, and to provide the data signal to the pixels;

a scan driver configured to provide a scan signal to the pixels; and a timing controller configured to control the data driver and the scan driver, wherein the degradation compensator is configured to generate the accumulate stress data comprising the stress data of adjacent pixels that are adjacent to the reference pixels by moving the one of the unit blocks in a moving path once after all of the stress values for all of the pixels of the one of the unit blocks are calculated.

2. The display device of claim 1, wherein the degradation compensator comprises:

a unit block determiner configured divide the display panel into the one or more unit blocks, and to move the unit blocks in the moving path;

a calculator configured to calculate the stress data of the pixels in the unit blocks;

a memory configured to receive the stress data from the calculator, and to store the accumulate stress data of each of the unit blocks; and a data compensator configured to compensate the image data based on the accumulate stress data.

3. The display device of claim 2, wherein the calculator is configured to calculate an average value of the stress values to represent a degradation degree of the pixels in the unit blocks, and to output the average value as the stress data in every frame.

4. The display device of claim 2, wherein the calculator sequentially outputs the stress value that represents a degradation degree of a respective pixel of the pixels in the unit blocks as the stress data in every frame.

5. The display device of claim 2, wherein the unit block determiner is configured to move the unit block in a first direction or a second direction to include the adjacent pixels.

6. The display device of claim 2, wherein the unit block determiner is configured to move the unit block to include pixels around the reference pixels.

7. The display device of claim 1, wherein the unit block moves by a movement amount in a frame.

8. The display device of claim 1, wherein the unit block moves by a movement amount that is less than 30% of either a length or a width of the unit block.

9. The display device of claim 1, wherein the unit block moves in a first direction, and in a second direction that is perpendicular to the first direction.

10. The display device of claim 1, wherein the unit block moves by a predetermined number of pixels.

11. A display device comprising:

a display panel comprising a plurality of pixels;

a degradation compensator configured to:

divide the display panel into one or more unit blocks initially comprising reference pixels;

calculate a stress data using the unit blocks;

compensate an image data to generate a compensation data based on an accumulate stress data comprising an accumulation of the stress data; and generate the accumulate stress data comprising the stress data of adjacent pixels that are adjacent to the reference pixels by moving the unit blocks in a moving path, a data driver configured to generate a data signal based on the compensation data provided from the degradation compensator, and to provide the data signal to the pixels;

a scan driver configured to provide a scan signal to the pixels; and a timing controller configured to control the data driver and the scan driver, wherein the degradation compensator comprises:

a unit block determiner configured divide the display panel into the one or more unit blocks, and to move the unit blocks in the moving path;

a calculator configured to calculate the stress data of the pixels in the unit blocks;

a memory configured to receive the stress data from the calculator, and to store the accumulate stress data of each of the unit blocks; and a data compensator configured to compensate the image data based on the accumulate stress data, wherein the calculator sequentially outputs a stress value that represents a degradation degree of a respective pixel of the pixels in the unit blocks as the stress data in every frame, and wherein the stress value of an outermost pixel of the pixels is output as the stress data when a number of pixels in one of the unit blocks at an edge of the display panel is less than a reference number.

12. A driving method of a display device comprising:

dividing a display panel comprising a plurality of pixels into one or more unit blocks initially comprising a plurality of reference pixels;

calculating a stress data using the unit blocks by calculating a stress value for each pixel of one of the unit blocks;

generating an accumulate stress data based on an accumulation the stress data;

moving the one of the unit blocks by a movement amount once after all of the stress values for all of the pixels of the one of the unit blocks are calculated; and compensating an image data to generate a compensation data based on the accumulate stress data.

13. The driving method of claim 12, wherein the stress data is calculated by calculating an average value of the stress values to represent a degradation degree of the pixels in a corresponding one of the unit blocks in every frame.

14. The driving method of claim 12, wherein the stress data is calculated by sequentially outputting the stress value representing a degradation degree of a respective pixel of the pixels in a corresponding one of the unit blocks in every frame.

15. The driving method of claim 12, wherein moving the unit blocks comprises moving a corresponding one of the unit blocks in a first direction to comprise pixels adjacent to the reference pixels.

16. The driving method of claim 12, wherein moving the unit blocks comprises moving a corresponding one of the unit blocks in a second direction to comprise pixels adjacent to the reference pixels.

17. The driving method of claim 12, wherein moving the unit blocks comprises moving a corresponding one of the unit blocks to comprise pixels around the reference pixels.

18. The driving method of claim 12, wherein moving the unit blocks comprises moving a corresponding one of the unit blocks by the movement amount in each frame.

19. The driving method of claim 12, wherein moving the unit blocks comprises moving a corresponding one of the unit blocks less than 30% of a dimension of the unit block.

20. The driving method of claim 12, wherein the movement amount comprises a predetermined number of pixels.

* * * * *